US006987486B2

(12) United States Patent
Kurjenheimo et al.

(10) Patent No.: US 6,987,486 B2
(45) Date of Patent: Jan. 17, 2006

(54) GROUND ARRANGEMENT FOR A DEVICE USING WIRELESS DATA TRANSFER

(75) Inventors: Timo Kurjenheimo, Oulu (FI); Kari Räisänen, Oulu (FI)

(73) Assignee: Micro Cell, S.A., Luxembourg, Zug (CH)

( * ) Notice: Subject to any disclaimer, the term of this patent is extended or adjusted under 35 U.S.C. 154(b) by 399 days.

(21) Appl. No.: 10/242,419

(22) Filed: Sep. 13, 2002

(65) Prior Publication Data

US 2003/0076272 A1 Apr. 24, 2003

(30) Foreign Application Priority Data

Sep. 14, 2001 (FI) ..... 20011815

(51) Int. Cl.
*H01Q 1/24* (2006.01)
*H01Q 9/16* (2006.01)

(52) U.S. Cl. ..... 343/702; 343/820

(58) Field of Classification Search ..... 343/702, 343/700 MS, 829, 841, 820
See application file for complete search history.

(56) References Cited

U.S. PATENT DOCUMENTS

| | | | | |
|---|---|---|---|---|
| 5,235,343 A | | 8/1993 | Audren et al. | 343/816 |
| 6,034,638 A | | 3/2000 | Thiel et al. | 343/702 |
| 6,061,025 A | | 5/2000 | Jackson et al. | 343/700 |
| 6,285,327 B1 | * | 9/2001 | See | 343/702 |
| 6,342,859 B1 | * | 1/2002 | Kurz et al. | 343/702 |
| 6,392,610 B1 | * | 5/2002 | Braun et al. | 343/876 |
| 6,614,399 B2 | * | 9/2003 | Trumbull et al. | 343/702 |
| 6,633,241 B2 | * | 10/2003 | Kaikuranta et al. | 341/33 |

FOREIGN PATENT DOCUMENTS

| | | |
|---|---|---|
| EP | 0 993 070 A1 | 4/2000 |
| FI | 75949 | 4/1988 |
| GB | 2 316 540 A | 2/1998 |
| GB | 2 351 847 A | 1/2001 |
| WO | WO99/54956 | 10/1999 |
| WO | WO 01/08255 A1 | 2/2001 |
| WO | WO 01/48858 A2 | 7/2001 |
| WO | WO 01/91235 A1 | 11/2001 |

OTHER PUBLICATIONS

Written Opinion, Jun. 16, 2003.

* cited by examiner

*Primary Examiner*—Wilson Lee
*Assistant Examiner*—Minh Dieu A
(74) *Attorney, Agent, or Firm*—Squire, Sanders & Dempsey L.L.P.

(57) ABSTRACT

The invention relates to a ground arrangement of a device using wireless data transfer. In order to improve the electric properties of the device and to minimize the SAR value of the device, at least one electrically conductive additional ground lead (73–75) is formed in the device in addition to the actual ground lead (72). In between the ground lead and the additional ground lead, a galvanic coupling is automatically established, when a predetermined switching criterion is fulfilled, and the aforementioned galvanic coupling is automatically released, when a predetermined release criterion is fulfilled. This enables one to change the ground configuration of an antenna such that it is as suitable as possible for the transmission and reception circumstances each time existing.

25 Claims, 3 Drawing Sheets

GROUND ARRANGEMENT FOR A DEVICE USING WIRELESS DATA TRANSFER

TECHNICAL FIELD OF THE INVENTION

The invention relates to the ground arrangement of a device using wireless data transfer, such as a mobile phone. By means of ground arrangement one tries to improve the electric properties of the device antenna as well as the performance of the device.

BACKGROUND OF THE INVENTION

Wireless terminal devices such as mobile phones must meet various requirements. As the physical size of the devices gets smaller, their size imposes their own requirements e.g. on the device structure, and particularly on the ground structure of the device. The antenna is a very important part of a terminal device operating at high frequencies, since it converts the signal received from the transmitter into electromagnetic waves and the electromagnetic waves into the signal to be received.

The antenna has to be capable of receiving and sending signal as well as possible under all circumstances. The frequency and output of a signal passing through the antenna may vary even to a great extent depending on the device, system and conditions, so as concerns the functioning of the device, it is substantial that the antenna operates under all circumstances as well as possible. In practice all antennas need a properly operating ground arrangement in order to efficiently function as emitters. The ground arrangement is herein also referred to as the "antenna ground", which is generally used to refer to the earth current arrangement that is used to achieve a low-impedance coupling to the ground potential or to the common reference point.

In practice, interfering signals are received into the antenna, which render difficult the normal functioning of the device, at least to some extent. The devices in use themselves cause interfering signals that may e.g. harm the operation of the components in the device.

Devices operating at a radio frequency cause electric and magnetic fields while in use. Such a place or point at which there is, or at which there each time is created, a concentration of electric or magnetic field is called a so-called hot spot. From the distribution of currents induced by the fields it is possible to approximately calculate the specific absorption rate (SAR), which indicates the output absorbed (e.g. by the bodily tissue) per mass unit. By means of the ground arrangement of the antenna it is possible to affect the magnitude of the SAR value.

In addition to the output, the SAR value depends e.g. on the frequency, the distance of the antenna in relation to the user, the service position of the phone and the antenna type. While the SAR values of the devices on the market are very small, there is an attempt to design the new devices in such a manner that one could get the SAR values smaller than before.

It is known to attach to the terminal devices various additional components that help extend the antenna ground of the terminal device when necessary, which means that the antenna amplification is bigger. The user has had e.g. to detach an additional component from the terminal device in order to introduce the ground extension. The aforementioned solution is therefore cumbersome in use.

The objective of the invention is to improve the features of the device as concerns the above-mentioned facts and to achieve a method more workable than before for controlling and changing the ground configuration of the device. In addition, the objective is to achieve a solution by means of which it is possible to direct the earth currents to a place as optimal as possible in such a manner that the created field concentrations are as far as possible from the user, in which case it is possible to obtain a small SAR value.

SUMMARY OF THE PRESENT INVENTION

The objective of the invention is to achieve a solution for a wireless terminal device by means of which it is possible to simply and flexibly optimize the electric properties of the device antenna, the performance of the device as well as to minimize the SAR value to be measured from the device.

This goal is achieved by a solution that has been described in the independent claims.

The idea of the invention is to form in the device, in addition to its actual ground lead i.e. ground route, one or more additional ground leads, and to change by means of it/them the ground configuration of the antenna, such as the effective length and/or area of the ground leads by automatically forming a galvanic coupling between the ground lead and one or more additional ground leads based on predetermined coupling criteria and by automatically releasing the coupling in question based on predetermined release criteria. In this manner it is possible to affect not only the SAR value but also the electric performance of the antenna. The ground lead and additional ground leads as well as the coupling criteria are designed for the device beforehand in such a manner that the desired features are achieved under varying transmission or reception circumstances.

The solution in accordance with the invention is used to achieve not only a small SAR value but also a low-loss antenna structure that has a VSWR value (VSWR=Voltage Standing Wave Ratio) as small as possible. By means of the invention it is also possible to achieve an antenna structure that operates in each situation with an optimal amplification.

In one advantageous implementation mode of the invention, the additional ground lead/leads are at least partly disposed in the cover part of the device, which enables one to implement various additional ground leads, and the place of the hot spots can be changed when necessary. The additional ground leads may be disposed on the surface of the cover material or inside it.

In another advantageous implementation mode of the invention, the additional ground leads are disposed in different layers of a multi-layer PC board. In this manner it is possible easily to implement additional ground leads that possess even very different sizes and shapes. The additional ground leads are easy to implement in respect of manufacturing technique on a multi-layer PC board, which makes the solution also cost-effective.

Since the effective length of the ground leads can be increased when necessary, it enables one to easily implement various ground configurations, from which the one each time most suitable is chosen. In practice, especially the frequency band to be used has an effect on the selection of the ground configuration (i.e. the additional ground lead each time most suitable).

The ground configuration in accordance with the invention can be easily implemented, and the user does not have to do anything in order to introduce a new ground configuration, but the introduction is performed automatically based on predetermined criteria.

BRIEF DESCRIPTION OF THE DRAWINGS

For a better understanding of the present invention and in order to show how the same may be carried into effect reference will now be made to the accompanying drawings, in which.

DETAILED DESCRIPTION OF CERTAIN EMBODIMENTS

Figure 1:
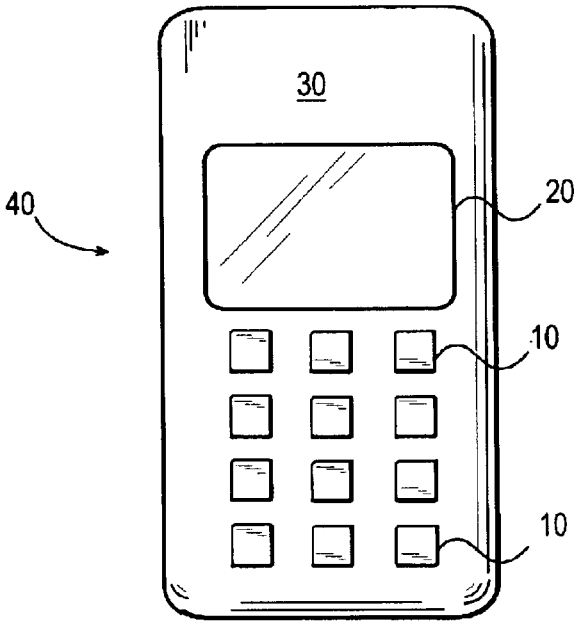
FIGS. 1 and 2 represent one terminal device according to the invention.

FIG. 1 shows a front view of a typical (subscriber) terminal device. The terminal device may be e.g. a mobile phone 40, which comprises, among other things, keys 10 and a display 20. The terminal device may also be some other device than a mobile phone, since from the standpoint of the invention substantial is only the fact that the device is capable of sending and receiving via an air interface.

The terminal device of FIG. 1 comprises a cover or enclosure structure, of which in the figure can be seen the front cover, i.e. the so-called A cover 30. The cover structure can be made e.g. of plastic, glass fiber or metal or a combination thereof.

Figure 2:
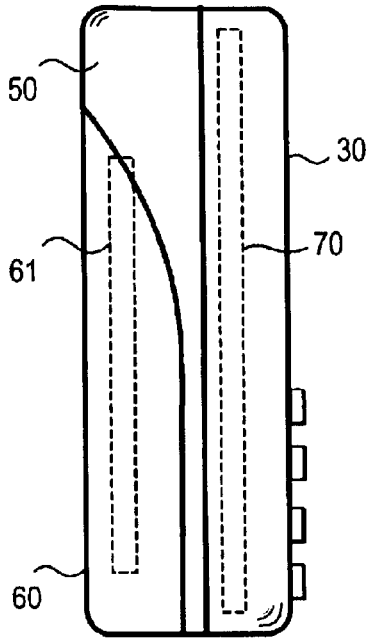

FIG. 2 shows a side view of the terminal device, which allows the cover structure of the terminal device to be better seen. In addition to the front cover, the terminal device comprises a rear cover, i.e. a so-called B cover, and an accumulator space 61 for the accumulator. The proposed terminal device comprises, in addition, an accumulator cover 60 for closing the accumulator space. The accumulator cover is thus in this implementation mode part of the cover structure of the terminal device. The A and B covers of the device as well as the accumulator cover can be detached from the rest of the device structure. The terminal device further comprises a circuit board 70, which is disposed inside the enclosure structure.

The ground arrangement according to the invention comprises an actual ground lead, one or more separate additional ground leads and coupling means, which enable one to automatically achieve a galvanic coupling between the ground lead and one or more additional ground leads in order to change the ground lead configuration to correspond to the changed transmission and reception circumstances, if desired. The number of cover parts of the terminal device is thus not so important as concerns the operability of the invention, instead substantial is that the device cover offers a space in which it is possible, e.g. in the manufacture phase of the device cover, to form one or more additional ground leads for the ground solution in accordance with the invention. The possible locations of the actual ground leads and additional ground leads are handled in more detail hereinafter.

The actual ground lead and additional ground leads are designed, in terms of qualities, (such as length, area and shape) beforehand in such a manner that the coupling and release of coupling of the additional ground leads enable one to achieve the desired effect on the functioning of the device. The physical measures of the additional ground leads are typically determined based on the frequency and output used. The seeking for the desired effect may happen also by way of experiment, as will be described hereinafter. It is possible to form even more additional ground leads, from which the one each time most suitable is chosen in order to provide the desired grounding network. It is also possible that from the additional ground leads, one chooses each time more than one to be connected to the actual ground lead.

In the selection of the additional ground lead to be used each time it is possible to take into account e.g. the transmission frequency and bandwidth of the antenna. This enables one to get the SAR and VSWR values of the device as small as possible. Furthermore, this enables one to optimize the antenna loss, and the antenna can be made to operate each time with optimal amplification.

Figure 3:
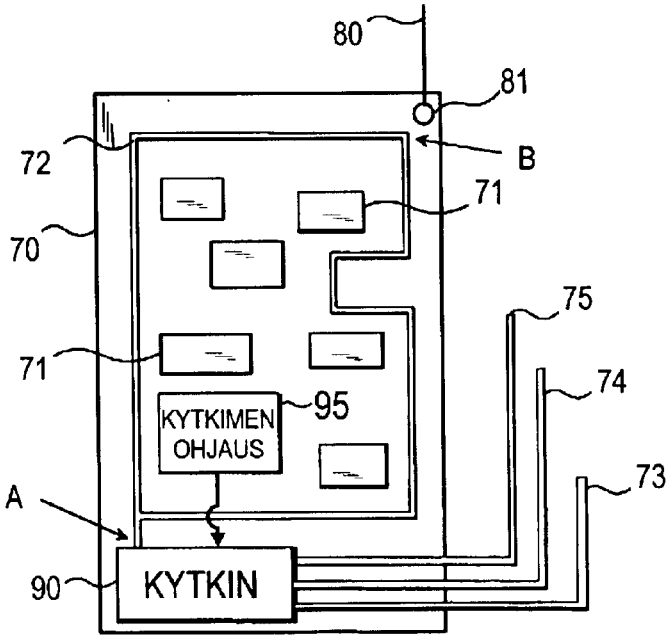
FIG. 3 represents one implementation mode of a ground arrangement.

FIG. 3 is a skeleton diagram which shows the device components substantial from the standpoint of the invention that are closely related to the operation of the antenna. The terminal device thus comprises an antenna 80, which may basically be of any known type, e.g. a so-called internal or a so-called external antenna. There are practically various antenna types, but the type to be used is of no great importance from the standpoint of the invention. At its simplest, the antenna is a so-called rod antenna, which is made of an electrically conductive material, and the resonance frequency of which is determined by the so-called electrical length of the antenna. Therefore, the effective length of a rod antenna e.g. in a mobile phone is typically e.g. $\lambda/4$, $3\lambda/8$ or $5\lambda/8$, wherein the wavelength $\lambda$ is determined based on the frequency band used by the device.

The antenna may also be e.g. a so-called helix antenna, in which case the cylindrical coil acts as an antenna. The electrical properties of the helix antennas to be used in mobile phones are typically $\lambda/4$, $3\lambda/4$ or $5\lambda/4$. In mobile phones, e.g. so-called micro strip antennas and so-called PIFA antennas (PIFA=Planar Inverted F Antenna) are used in addition. The PIFA antennas enable one to achieve a particularly good radiation pattern and low VSWR value. In addition, the PIFA antennas are suitable for use at a wide frequency band.

The terminal device may comprise even several separate antennas, e.g. if the antenna utilizes several different frequency bands. The same mobile station may be used to establish connections e.g. in the frequency ranges of 900 MHz, 1800 MHz and 1900 MHz.

For the sake of simplicity, let it be stated that the device comprises, as shown in FIG. 3, only one antenna 80, which in this case is a rod antenna. The antenna is connected at its one end to the antenna feed point 81, which is disposed on the device's circuit board 70, which comprises various components 71. In this case, the circuit board is a so-called single-layer PC board. In addition to these, on the circuit board there has been formed a ground lead 72 made of an electrically conductive material, which acts as an antenna ground lead. The ground lead thus represents the ground plane in which there is the ground potential acting, and it acts not only as an antenna ground lead but also as the ground of the components on the circuit board.

The length, area and shape of the ground lead have an effect on the functioning and properties of the antenna and device, which is why the physical measures and shape of the ground lead may vary even to a great extent for each case specifically.

The physical properties of the ground lead have thus an effect e.g. on the SAR and VSWR values of the device as well as on the antenna amplification and antenna losses. The solution in accordance with the invention renders possible the functioning of the antenna at frequencies more several than before and in a frequency band wider than before. In practice it has been found that the solution in accordance with the invention enables one to increase the antenna amplification by over 0.5 dB and the band by over 3% as compared to the corresponding known methods.

The device further comprises a switch 90 disposed on the circuit board, which switch 90 is connected to the lead 72. More specifically, the switch 90 is connected to point A of the lead, which is the remotest point in the lead with respect to the antenna feed point 81. As discussed above, the length, shape and area of the ground lead affect the functioning of the antenna. There has been marked in the figure point B from which there is the shortest distance to the antenna feed point 81. As concerns the functioning of the antenna important is the shortest total length of the lead 72 from the antenna to the remotest point. In other words, as concerns the antenna, the effective length of the ground lead corresponds to the aforementioned shortest route along the lead 72 from point B to point A. Therefore, the length of the lead 72 "visible" to the antenna may be changed by means of an additional ground lead, if necessary.

In the example of FIG. 3, the device comprises three electrically conductive additional ground leads 73, 74 and 75 that are of unequal length and are connected to the switch 90. The one end of each of the additional ground leads is free. While the additional ground leads are in this example like a long lead, their physical measures may vary in various ways, and they may be even very different in respect of their width, length and shape. If necessary, at least one additional ground lead is connected by means of a switch to the actual ground lead 72, thereby increasing the effective length of the ground lead 72. Each additional ground lead may, in addition, be located in a different place with respect to the antenna, in which case the additional lead connected to the actual ground lead may affect even to a great extent the SAR and VSWR values of the antenna and device, although the lengths of the additional leads would correspond to one another a lot.

Figure 4:
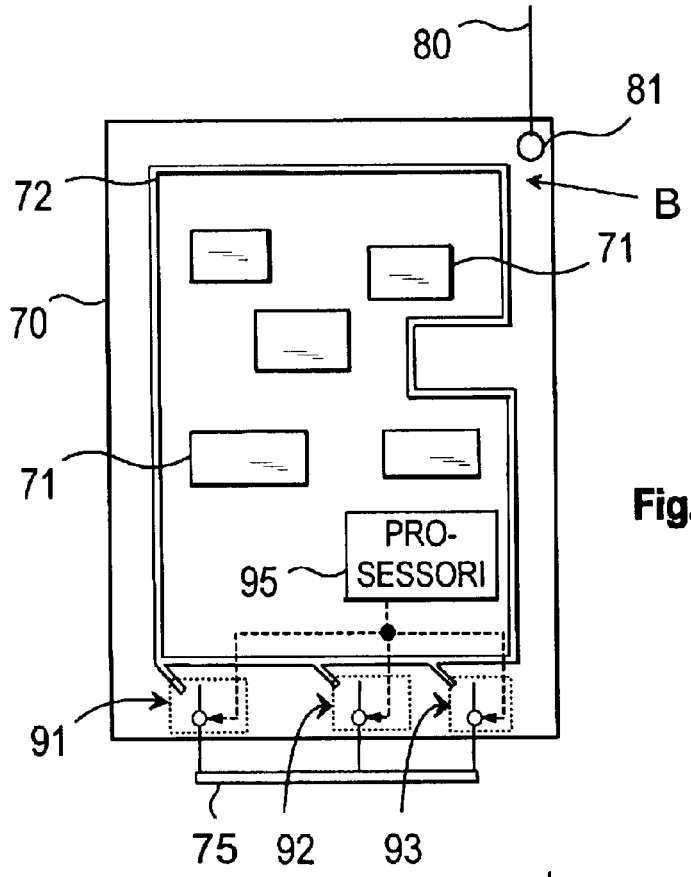
FIG. 4 represents another implementation mode of a ground arrangement.

FIG. 4 shows another implementation mode of the terminal device. The device comprises on a circuit board 70 three switches 91, 92 and 93, which are connected to the ground lead 72, which also in this case consists of a conductive pattern on a circuit board. In this case, there is in the device only one additional ground lead 75. The switches 91–93 are so disposed that each of them connects the point of the ground lead corresponding to the switch to a certain point of the additional ground lead. In the case as shown in FIG. 4, all the switches are open, which means that the additional ground lead is not connected to the actual ground lead 72.

The galvanic coupling between a ground lead and one or more additional ground leads may be implemented e.g. using components based on the so-called MEMS technology (MEMS=Micro-Electro Mechanical Systems), which components are very small as concerns their physical size in comparison to the corresponding macroscopic counterparts, such as the semiconductor switches. The switches can be e.g. micro relays that have been manufactured using the MEMS technology. Thanks to its process engineering and structure, a micro relay is easy to encapsulate in ordinary SMD enclosures (SMD=Surface Mount Devices). Furthermore, the switches may be implemented e.g. using a PIN diode that is suitable for use in switching applications of various high-frequency signals.

Figure 5:
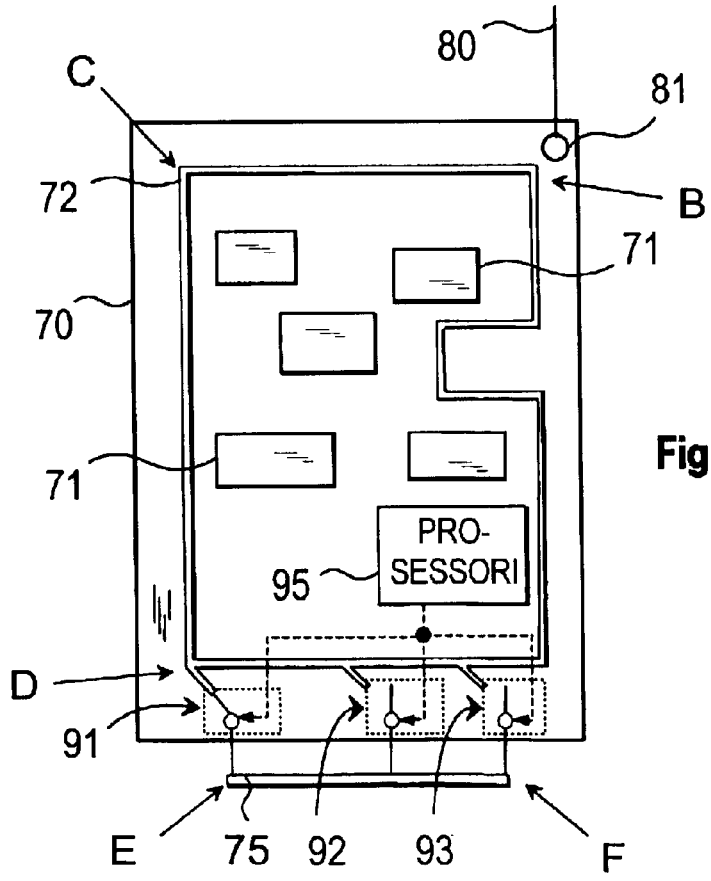
FIG. 5 represents the ground arrangement of FIG. 4, when the additional ground lead is in use.

FIG. 5 shows the terminal device of FIG. 4 in a situation in which the additional ground lead 75 is connected to the actual ground lead 72 by the switch 91. In this situation, the switch 91 is thus closed, thereby galvanically connecting the additional ground lead to the actual ground lead. In the situation as shown in FIG. 5, the effective total length of the antenna ground consists of the route B-C-D-E-F. In addition, due to the coupling of the additional ground lead, one has managed to change the shape of the ground.

The device comprises a control means 95, which is practically a microprocessor that controls the closing and opening of the switches. The microprocessor controls the switches based on predetermined switching and release criteria. Typically these criteria include at least the piece of information on the frequency band and/or transmission output used by the device. In a simple embodiment, for each frequency range, there may be an additional ground lead of its own, which is connected to the ground lead 72, when the device uses the frequency range in question. It is also possible to determine for the device with what length of ground lead and ground configuration one may obtain the most preferred SAR and VSWR values in relation to the frequency and frequency band used. When the most preferred ground lead configurations have once been determined, the lead configurations corresponding to them as well as the switching means with their corresponding switching and release criteria may be introduced in the manufacture phase of the devices.

When the device is in use, it is possible, e.g. in conjunction with the change of the frequency band, to change the ground routes (based on a definition made beforehand) in such a manner that the desired features are achieved, such as the maximal antenna amplification or the moving of the hot spot to a preferable location as concerns the SAR value.

When an additional ground lead is connected to serve as an extension of the actual ground lead, not only the length of the ground lead will change but also the additional ground lead is disposed in such place or position in relation to the actual ground lead that also the shape of the ground lead has changed to correspond to the changed transmission or reception circumstances. By changing the shape of the ground lead it is possible to further improve the features of the antenna, and it enables one to avoid the problems caused by various interference fields.

When the shape of the ground is changed, at the same change also the routes via which the high-frequency ground currents pass that have an effect e.g. on the magnitude of the SAR value. By automatically changing the shape of the ground routes it is possible to control the location of the hot spots in the device. The electric and magnetic fields created are directed in the device structure to such a place in which the fields are more far off from the user of the device.

Figure 6:
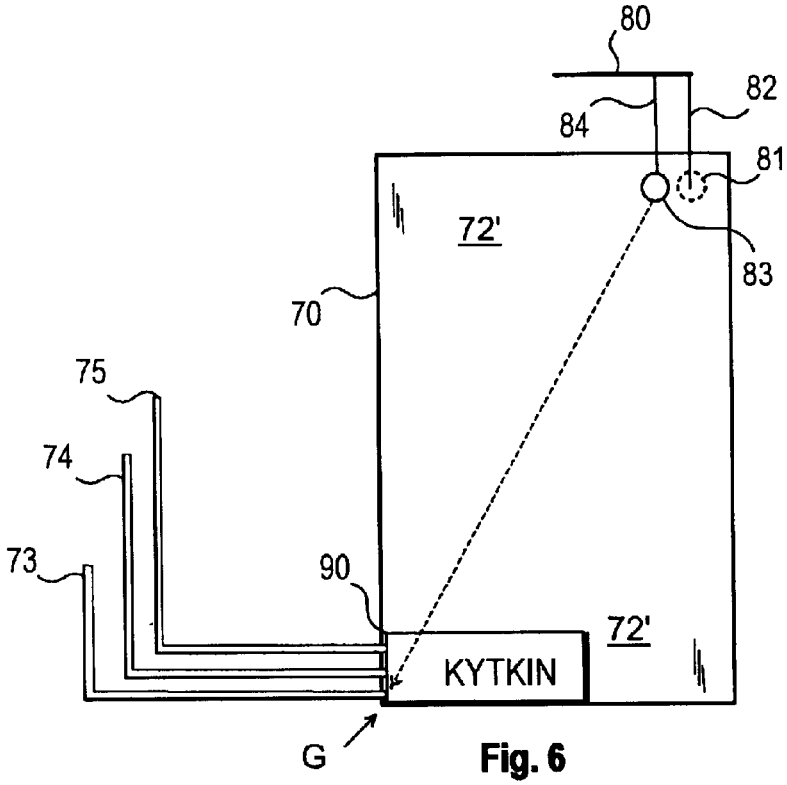
FIG. 6 represents a third implementation mode of the ground arrangement.

FIG. 6 illustrates one advantageous implementation mode of a terminal device that comprises a multi-layer PC board 70. FIG. 6 shows of the circuit board a layer that has been totally coated with an electrically conductive material. In other words, the presented layer 72' of the circuit board functions as the actual ground lead.

In FIG. 6, the terminal device comprises an antenna 80, which in this case is a PIFA antenna. The terminal device comprises an antenna feed line 82, which at the first end is connected to the feed point 81 disposed on the circuit board, and at the second end to the antenna 80, which is a conductive material. The feed line is, however, not connected to the ground lead at the end where the feed point 81 is, instead the terminal device comprises, in addition, a short circuit, i.e. a short circuit wire 84, whose first end is connected to the ground lead 72, and the second end to the antenna. The point at which the first end of the short circuit wire 84 is connected to the ground lead 72' is called a ground contact, and it is marked with reference numeral 83. The one end of the short circuit wire 84 of the antenna and the one end of the feed line 82 are galvanically connected to one another through the antenna.

In the structure as shown in FIG. 6, the switch 90 has been placed on the circuit board as far as possible from the ground contact 83 of the antenna in order that the actual ground would be as long as possible from an antenna standpoint. As can be further seen from the figure, the ground contact and switch 90 have been placed in the opposite corners of the circuit board with respect to one another in order to get the length of the actual ground lead 72' as big as possible from an antenna standpoint. The effective length corresponds in this case to the distance between the ground contact 83 and point G marked in the figure. When an additional ground lead is connected to serve as an extension of the actual ground lead, the total length of the ground lead of the device can be increased even more from an antenna standpoint, which enables one to move the hot spots as far as possible from the user of the device. The additional ground leads may be disposed on the circuit board or in the cover structure of the device.

Figure 7:
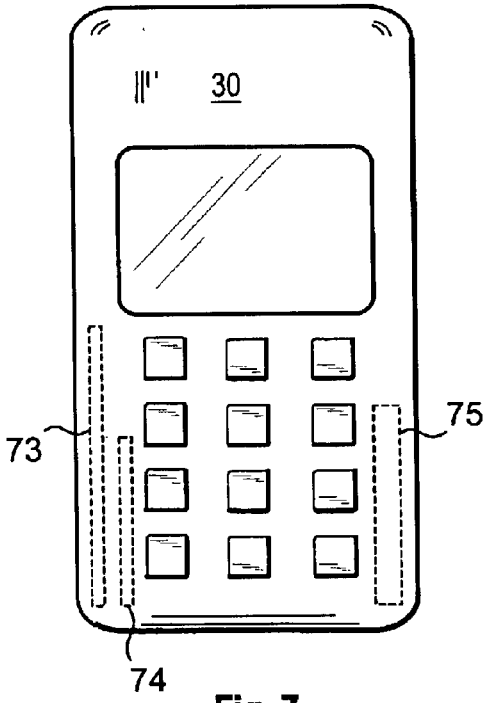
FIG. 7 represents a terminal device according to the invention.

FIG. 7 shows a front view of one device in accordance with the invention. The device as shown in the figure comprises additional ground leads 73, 74 and 75 on the inner surface of the A cover 30. In the solution as shown in the figure, the additional ground leads are straight wires, but the shape of the wires may vary. The additional ground lead may be disposed also in the B cover, accumulator cover or some other structural element. The additional ground lead is invisible to the user, unlike in the above-mentioned prior-art embodiments, since in the solution in accordance with the invention, the additional ground lead is automatically introduced.

Figure 8:
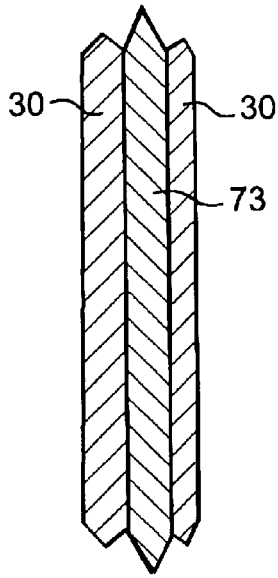
FIG. 8 represents one implementation mode of the location of the additional ground lead.
Figure 9:
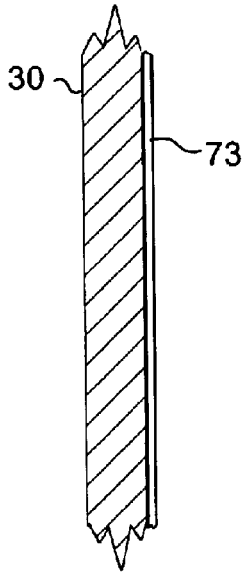
FIG. 9 represents another implementation mode of the location of the additional ground lead.

FIGS. 8 and 9 show in more detail the possible locations of the additional ground in the device structure. In the example of FIG. 8, the additional ground lead 73 is inside the cover structure. The additional ground lead may be placed in between the inner and outer surface of the cover structure most easily in the manufacture phase of the device cover. If the cover structure is e.g. plastic, it is quite easy to implement a conductive additional ground in the cover structure in the manufacture phase. In principle the cover can even wholly be made of an electrically conductive material, but in that case the cover has to be isolated from the additional ground lead.

In the implementation mode as shown in FIG. 9, the additional ground 73 is disposed on the surface of the device cover. The wire film which forms the additional ground lead may e.g. be glued or attached in some other suitable manner e.g. to the inner surface of the device cover. The additional ground lead may thus be disposed e.g. in the A cover, B cover, accumulator cover, or on the inner surface of some other device component. It may be disposed e.g. in the accumulator space of the device, in which case it would be on the outer surface of the B cover. The additional ground lead may be disposed e.g. in the rear cover of the mobile station, which enables one to move the hot spot as far as possible from the user of the device.

The disposition of the additional grounds in the cover is in that sense preferable that the cover structure provides a possibility of implementing additional ground leads that are physically even very different and big in respect of their area, and at the same time the hot spots may be directed to the desired place in the device. It is, however, possible to implement the additional ground leads in such a manner that they are wholly disposed on the circuit board. Since there normally is only a little space on the circuit board, they may be disposed in one or more (additional) layers of a multi-layer PC board (FIG. 6). For example, the additional ground lead for each frequency range may be disposed in its own layer. It is advantageous to dispose the actual ground lead wholly on the circuit board, regardless of whether one uses a one-layer or a multi-layer PC board in the device.

The ground plane (ground lead plus additional ground leads) has at each frequency an optimal minimum length, which enables one to achieve sufficient antenna amplification. The decreasing of the SAR value is achieved e.g. in such a manner that the hot spot is moved in the device to such a place in which it is possible to measure for the device a small SAR value. The SAR and VSWR values are not directly dependent on each other. When a good VSWR value is obtained, it is likely that also the antenna amplification increases. In order to achieve good antenna amplification, the antenna coupling has to be good (a small VSWR value), the length of the ground lead has to be optimal and the antenna emitter has to be disposed in a free place as concerns the RF features. If one generalizes a little, it can be said that the length of the necessary ground plane is the bigger the smaller is the frequency. The length of the necessary ground plane is, however, dependent on many factors, e.g. on the location of the ground, its shape and the rest of the device structure.

While the invention has been described above with reference to the examples according to the attached drawings, it should be understood that the invention is not limited to them, instead a person skilled in the art can vary the proposed solutions without departing from the inventive idea. If there are in the device e.g. several antennas, each of them may have at least partly their own ground arrangements, as described above, or there may be common additional ground leads for all antennas.

What is claimed is:

1. A method for implementing a ground arrangement of a device using wireless data transfer, the device comprising a cover structure composed of at least one cover part, an antenna and a ground lead for the antenna, wherein in the device, at least one electrically conductive additional ground lead is formed, in between the ground lead and additional ground lead, a galvanic coupling is automatically established, when a predetermined switching criterion is fulfilled, and the aforementioned galvanic coupling is released, when a predetermined release criterion is fulfilled.

2. A method according to claim 1, wherein in the device, several additional ground leads are formed, each of which can be separately coupled to the ground lead and detached from the ground lead.

3. A method according to claim 2, wherein the additional ground leads are adapted such that they are different from one another in such a manner that the coupling of each additional ground lead to the ground lead changes the effective length of the ground by a different amount from an antenna standpoint.

4. A method according to claim 1, wherein each additional ground lead is formed of a lead whose free end is physically directed to the desired point in the device.

5. A method according to claim 1, wherein the ground lead is placed on the circuit board of the device, and the additional ground leads in the cover structure of the device.

6. A method according to claim 5, wherein the free ends of the additional ground leads are directed to different places in the cover structure of the device.

7. A method according to claim 1, wherein the ground lead and additional ground leads are placed in different layers of a multi-layer PC board.

8. A method according to claim 1, wherein the switching and release criteria depend at least on the frequency band each time used by the device.

9. A method according to claim 1, wherein the switching and release criteria depend at least on the transmission output each time used by the device.

10. A method according to claim 1, wherein the additional ground lead enables one to affect the electric properties of an antenna.

11. A method according to claim 10, wherein the additional ground lead enables one to affect the antenna amplification of a terminal device.

12. A method according to claim 10, wherein the additional ground lead enables one to affect the VSWR value of an antenna.

13. A method according to claim 1, wherein the additional ground lead enables one to affect the SAR value caused by the device.

14. A device utilizing wireless data transfer, comprising a cover structure composed of at least one cover part, an antenna, and a ground lead, which is fitted inside the cover structure, wherein the terminal device further comprises at least one electrically conductive additional ground lead, at least one switch for establishing a galvanic coupling in between the ground lead and the additional ground lead, and a control means, which is adapted to control the aforementioned at least one switch for establishing the aforementioned galvanic coupling and releasing based on predetermined criteria.

15. A device according to claim 14, wherein the ground lead is formed on a circuit board in the device, and the additional ground lead at least partly in the cover part of the device.

16. A device according to claim 15, wherein the additional ground lead is formed inside the cover part material.

17. A device according to claim 15, wherein the additional ground lead is formed on the inner surface of the cover part.

18. A device according to claim 14, wherein a ground lead and at least one additional ground lead are formed on circuit board in the device.

19. A device according to claim 18, wherein the ground lead and additional ground leads are disposed in different layers of a multi-layer PC board.

20. A device according to claim 14, wherein the additional ground lead is adapted to begin at the point of the ground lead where the distance from the antenna is the biggest, when the distance to the point in question is measured using the shortest route along the ground lead.

21. A device according to claim 14, wherein it comprises several additional ground leads.

22. A device according to claim 14, wherein the additional ground leads are formed such that they are different in respect of their physical measures in such a manner that the switching of each changes the electric properties of the antenna in a different way.

23. A device according to claim 14, wherein it comprises several switches, which are adapted to be coupled to different points of the ground lead.

24. A device according to claim 14, wherein it is a portable subscriber terminal device.

25. A device according to claim 24, wherein said portable subscriber terminal comprises a mobile station.

* * * * *